US008002051B2

(12) United States Patent
Finkenzeller

(10) Patent No.: US 8,002,051 B2
(45) Date of Patent: Aug. 23, 2011

(54) CONNECTION DEVICE FOR FORMING A FLUID SUPPLY

(75) Inventor: Stefan Michael Finkenzeller, Reichertshofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 77 days.

(21) Appl. No.: 12/453,039

(22) Filed: Apr. 28, 2009

(65) Prior Publication Data

US 2009/0266616 A1 Oct. 29, 2009

(30) Foreign Application Priority Data

Apr. 28, 2008 (EP) ..... 08008125

(51) Int. Cl.
*E21B 17/18* (2006.01)
*E21B 21/015* (2006.01)

(52) U.S. Cl. ..... 175/209; 175/324

(58) Field of Classification Search ..... 175/209, 175/324, 325.2, 325.3
See application file for complete search history.

(56) References Cited

U.S. PATENT DOCUMENTS

| | | | | |
|---|---|---|---|---|
| 3,485,309 | A | 12/1969 | Lawrence et al. | |
| 4,732,226 | A | 3/1988 | Ebeling et al. | |
| 5,125,692 | A * | 6/1992 | Sinclair et al. | 285/121.5 |
| 5,181,576 | A * | 1/1993 | Askew et al. | 175/61 |
| 5,199,515 | A * | 4/1993 | Sinclair et al. | 175/213 |
| 5,265,684 | A * | 11/1993 | Rosenhauch | 175/61 |
| 5,293,945 | A * | 3/1994 | Rosenhauch et al. | 175/325.2 |
| 5,308,150 | A * | 5/1994 | Whitehouse | 299/61 |
| 5,325,932 | A * | 7/1994 | Anderson et al. | 175/325.3 |
| 5,429,198 | A * | 7/1995 | Anderson et al. | 175/230 |
| 5,836,406 | A * | 11/1998 | Schuh | 175/61 |
| 5,931,239 | A * | 8/1999 | Schuh | 175/61 |
| 5,931,601 | A * | 8/1999 | Terada et al. | 405/138 |
| 6,158,533 | A * | 12/2000 | Gillis et al. | 175/325.1 |
| 6,244,361 | B1 * | 6/2001 | Comeau et al. | 175/61 |
| 6,290,003 | B1 * | 9/2001 | Russell | 175/73 |
| 2002/0185314 | A1 * | 12/2002 | Cargill et al. | 175/57 |
| 2005/0098353 | A1 * | 5/2005 | Maxwell et al. | 175/57 |
| 2006/0032644 | A1 | 2/2006 | Stoetzer | |
| 2006/0289154 | A1 * | 12/2006 | Robichaux et al. | 166/85.1 |

FOREIGN PATENT DOCUMENTS

| | | | |
|---|---|---|---|
| DE | 3609111 | A1 | 10/1987 |
| EP | 0855490 | A2 | 7/1998 |
| EP | 1559864 | A1 | 8/2005 |
| EP | 1630301 | A1 | 3/2006 |
| WO | WO 2005/090739 | A1 | 9/2005 |

* cited by examiner

*Primary Examiner* — Jennifer H Gay
(74) *Attorney, Agent, or Firm* — Jacobson Holman PLLC

(57) ABSTRACT

A connection device for forming a fluid supply to a rotating tool, in which is provided a rotary feedthrough which has a rotor and a stator, the rotor being supported in a rotating manner relative to the stator. Furthermore, a torque support is provided, which is connected in a rotationally fixed manner to the stator and has at least one contact element. The at least one contact element can be displaced between a retracted position and a protruding position, in which the contact element is extended compared to the retracted position for the purpose of torque support.

11 Claims, 2 Drawing Sheets

CONNECTION DEVICE FOR FORMING A FLUID SUPPLY

BACKGROUND OF THE INVENTION

1. Field of the Invention

The invention relates to a connection device for forming a fluid supply to a rotating tool, in particular an earth drilling tool, comprising a rotary feedthrough which has a rotor that can be connected to the rotatably driven tool and a stator, the rotor being supported in a rotating manner relative to the stator, and comprising a torque support which is connected in a rotationally fixed manner to the stator and has at least one contact element.

2. Description of Related Art Including Information Disclosed Under 37 CFR §§1.97 and 1.98

A device of such type is known for example from DE 690 13 666 T2. This known connection device connects a drilling tool to a drive string, in which case conveying air is transferred via stationary supply lines located on the drive string to the rotating drilling tool. For this purpose a star-shaped torque support is provided on the upper part of the connection device, through which the stator, that is stationary relative to the rotating drilling tool, is supported together with the upward running supply lines with respect to the drill hole wall.

This known connection device can only be employed in each case for the provided drilling tool with the predetermined drilling diameter. In addition, depending on the soil material to be worked upon, the contact pressures of the torque support on the wall of the drill hole can be too high or too low in some cases of application.

BRIEF SUMMARY OF THE INVENTION

The invention is based on the object to provide a connection device that can be employed in a particularly flexible manner.

The object is solved in accordance with the invention by a connection device for forming a fluid supply to a rotating tool, in particular an earth drilling tool, comprising a rotary feedthrough which has a rotor, that can be connected to the rotatably driven tool, and a stator, the rotor being supported in a rotating manner relative to the stator, and comprising a torque support which is connected in a rotationally fixed manner to the stator and has at least one contact element, wherein the at least one contact element can be displaced between a retracted position and a protruding position, in which the contact element is extended as compared to the retracted position for the purpose of torque support.

The connection device according to the invention is characterized in that the at least one contact element can be displaced between a retracted position and a protruding position, in which the contact element is extended as compared to the retracted position for the purpose of torque support.

A fundamental idea of the invention resides in the fact that a torque support with contact elements that are capable of being protruded is provided on a rotating tool. Due to the protrusive ability of the contact elements the connection device can be employed on different tools with different tool diameters. In this case adjustment of the torque support takes place through an appropriate retraction or extension of the contact elements to the respective tool diameter. When being used in drill holes it is also possible to change the contact pressure of the contact elements on the drill hole wall and to adjust the pressure to the requirements of the material of the drill hole wall.

In addition, the connection device according to the invention can also be employed in drill holes having varying drilling diameters in the drilling direction. Furthermore, with the connection device according to the invention the contact elements can be folded back when required, such as for example during introduction or withdrawal of the drilling tool when a torque support is not needed.

Basically, the connection device can be arranged in a fixed manner on a tool or a drive string, such as a drill rod. In accordance with the invention it is particularly preferred that a connecting string is provided having on the one hand a first connecting means to a driving device and on the other hand a second connecting means to the tool and that the torque support is arranged along the circumference of the connecting string. In this way the connecting string can serve as a kind of adapter that is arranged between the tool and the driving device, more particularly a drive string or a drill rod. Hence, the connection device can be employed in a flexible manner on various drilling tools and drill rods. The connecting means can include conventional rotary connections, as for example polygonal connections with bolt locks, as they are used on Kelly bars of the known type.

Furthermore, in accordance with the invention it is of advantage that an axially displaceable actuating member is provided and that a transmission means is provided, through which an axial movement of the actuating member can be converted into a radial movement of the at least one contact element. Basically, the actuating member can be an actuating cylinder, such as a hydraulic or compressed-air cylinder, which is arranged equidirectionally to the axis of rotation or drilling axis of the tool. As a result of this arrangement sufficient free space is available as compared to a radially directed cylinder arrangement that is possible, too.

Compared to an energy-operated actuating member it is especially preferred according to the invention that the actuating member can be moved through a relative movement of the connecting string with respect to the tool and/or the driving device. More particularly, this can be implemented in a drilling tool for example in that the tool is placed by the drill rod onto the ground or the bottom of the drill hole. On account of the axial compressive force occurring during the drilling an axial relative movement of the actuating member can be brought about so that during the drilling operation a desired protrusion of the at least one contact element takes place automatically.

In this connection it is especially advantageous that a tensioning device is provided, by means of which the at least one contact element can be retained in the retracted position. For instance if a drilling tool is lifted from the ground or the bottom of the drill hole, the tensioning device causes a return movement of the contact elements into the retracted position. By preference, the tensioning device can have tension springs, which, depending on the arrangement, can be designed as compression or draw springs.

According to the invention an especially stable arrangement results from the fact that the actuating member is arranged in a ring-shaped manner on the connecting string.

In particular with the preferred embodiment, in which several contact elements are distributed along the circumference of the connecting string, the advantageous gain is that the actuating forces and retracting forces present in a transverse direction to the axis of rotation of the tool, i.e. in a radial direction, compensate each other to a large degree. As a result, the entire arrangement is load-relieved.

A further preferred embodiment of the invention results from the fact that the transmission means has a lever mechanism. Through an appropriate arrangement with levers that are hinge-connected to each other it is possible to generate the desired actuating movements and contact forces with relatively small actuating forces.

Another particularly useful embodiment of the invention resides in the fact that the at least one contact member has a roller body. The roller body is in contact with the environment, especially with a drill hole wall. By preference, a roller axis of the roller body is directed tangentially to the drilling axis or longitudinal axis of the tool so that when the torque support is moved in the axial direction a roll-off movement takes place and, notwithstanding, on achieving the function of a torque support a good support is attained in the circumferential direction.

An effective operation of the contact elements that are capable of being protruded is provided in accordance with the invention in that the first connecting means and/or the second connecting means is designed as an axially movable rotary connection. In this way the rotary connection can be attained in a known manner by a polygonal connection, especially by a square connection. An axial securing can be achieved by a bolt which is directed transversely to the longitudinal or drilling axis whilst jutting out through a slotted hole. The slotted hole extends in the longitudinal or drilling direction. This permits an axial relative movement between the connecting string and the tool or the driving device.

The provided rotary feedthrough is designed in a generally known manner with a stator and a rotor. According to the invention provision is made in particular for the stator to have at least one first line connection for a fluid, said connection being stationary with respect to a surrounding environment, for example surrounding soil, and for the rotor to have at least one second line connection, which is stationary with respect to the tool. The line connection of the stator can be a conventionally used hose or line connection for a fluid or a gas. As a rule, the stator has at its inner side a ring-shaped duct that corresponds with a matching duct or matching openings on the rotor. Through the arrangement of appropriate sealings, a fluid transmission can thus take place from a stationary to a rotating component.

Preferably, provision is made according to the invention for the connecting string to be designed as a hollow shaft for the conveyance of fluid. Through one or more appropriate radial bores in the tubular connecting string a line connection leading from or to the rotor can thus be formed.

BRIEF DESCRIPTION OF THE SEVERAL VIEWS OF THE DRAWINGS

In the following the invention will be described further by way of preferred embodiments shown schematically in the accompanying drawings, wherein.

DETAILED DESCRIPTION OF THE INVENTION

Figure 1:
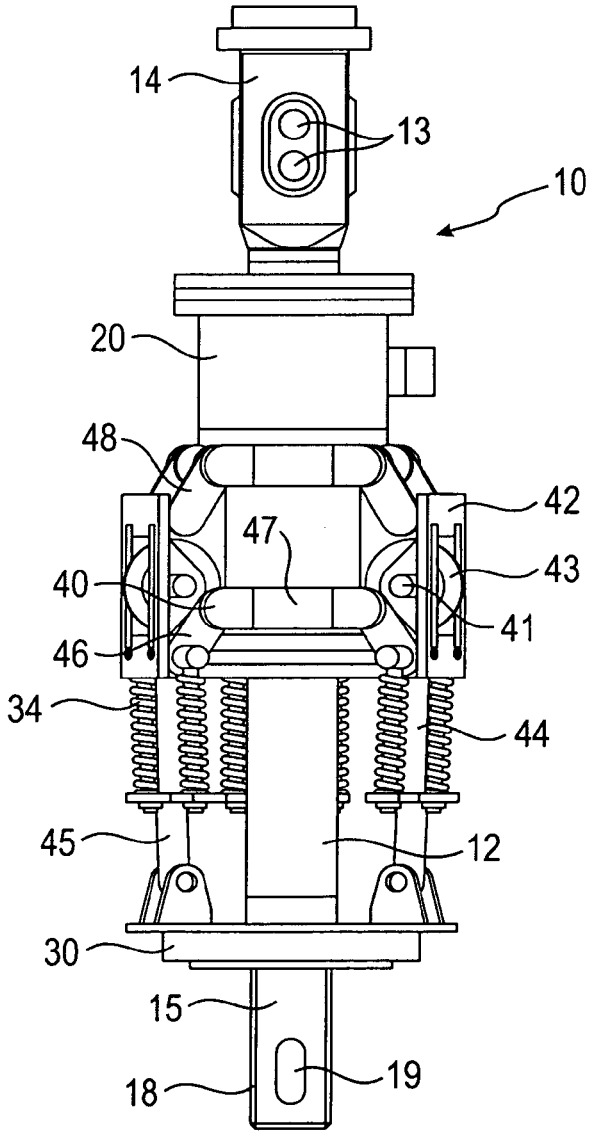
FIG. 1 shows a side view of a connection device in accordance with the invention.
Figure 2:
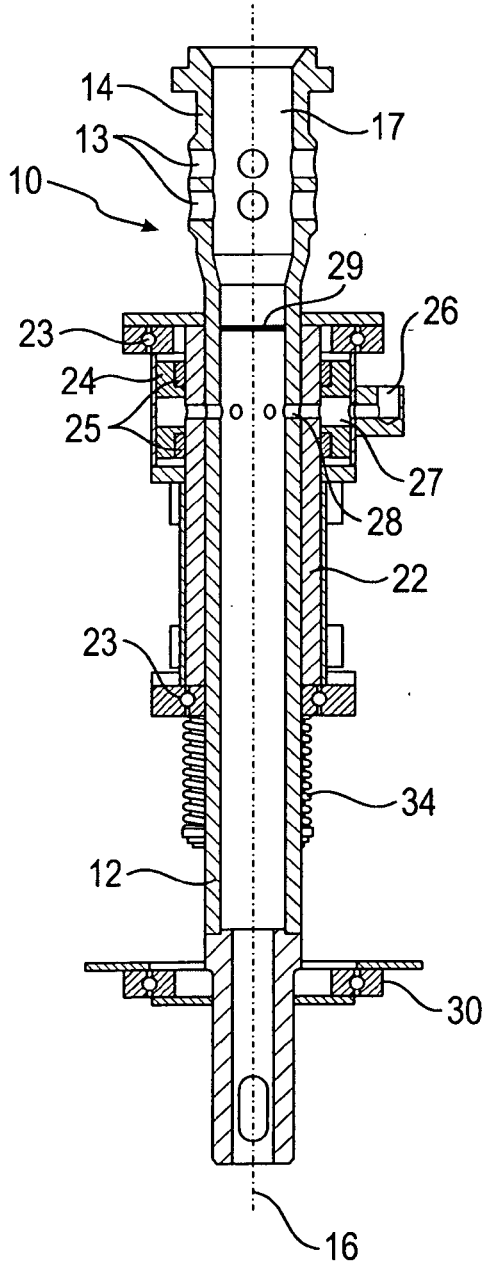
FIG. 2 shows a schematic part cross-sectional arrangement of the connection device of FIG. 1.

In accordance with FIGS. 1 and 2 a connection device 10 according to the invention is shown, which has a tubular connecting string 12 along a longitudinal or drilling axis 16. In the central part of the connecting string 12 a ring-shaped rotary feedthrough 20, also referred to as a flushing head, and a torque support 40 are arranged along the circumference of the connecting string 12.

Figure 3:
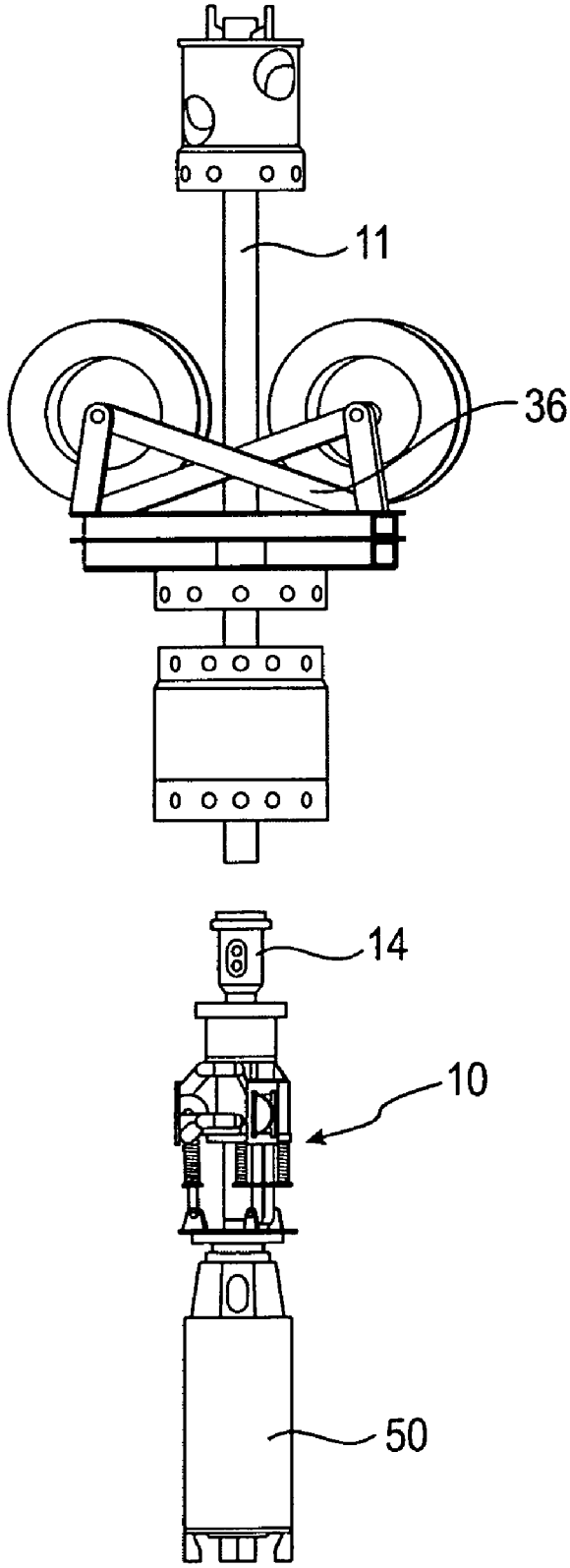
FIG. 3 shows a schematic side view of a connection device according to the invention with a drilling tool.

On its upper side the connecting string 12 has a first connecting means 14 that comprises a square hole 17 for connection with a drill rod 11, which is shown in FIG. 3. By means of appropriate transversely directed cross-bores 13 an axial securing and connection to the drill rod can take place through retaining bolts. At the lower end of the connecting string 12 a corresponding square stud 18 is arranged that has a slotted hole 19 for axial securing. The slotted hole 19 is directed longitudinally of the longitudinal or drilling axis 16 in order to be able to accommodate a cross-bolt in an axially movable manner. In this way the second connecting means 15 is designed as a rotary connection, by which a connection having axial mobility with respect to a drilling tool is rendered possible.

The rotary feedthrough 20 permits in a generally known manner a fluid connection of fluid lines, which are stationary relative to the surrounding environment and are connected via a first line connection 26 to a ring-shaped stator 24. The sleeve-shaped stator 24 has a central ring-shaped duct 27, which is sealed by a respective sealing ring 25 towards both axially facing sides and towards the inside with respect to a sleeve-shaped rotor 22 that rotates relative to the said stator. On the axial height of the ring-shaped duct 27 the rotor 22 has a plurality of transversely directed radial bores that constitute a second line connection 28 to the inner space of the connecting string 12 designed as a hollow shaft. The inner space of the hollow connecting string 12 is sealed in the upward direction by a closure element 29 so that the inner space of the hollow connecting string 12 can serve as a fluid line leading downwards to a drilling tool. A rotating support of the stator 24 with respect to the rotor 22 which is coupled in a fixed manner with the connecting string 12 takes place in a generally known manner by means of rotary bearings 23.

To support the stator 24 with respect to a drill hole wall not shown here the torque support 40 has several plate-shaped contact elements 42, on the inside of which a roller body 43 is each supported in a rotatable manner about a roller axis 41. The roller axis 41 is directed tangentially to the longitudinal or drilling axis 16, whereby a roll-off movement of the torque support 40 can take place in the direction of the longitudinal or drilling axis 16. To this end the roller bodies 43 partly jut out through an opening in the plate-shaped contact elements 42.

By means of upper levers 46 the contact elements 42 are supported on a support ring 47 in such a manner that they can protrude in a radial direction. In addition, the upper levers 46 are hinge-connected to an upper end of lower levers 45, which are supported for their part on a ring-shaped actuating member 30 and are each hinge-connected to the latter.

By means of a tensioning device 34 having two compression springs on each of the lower levers 45 the respective contact element 42 is kept in a retracted position which is depicted in FIG. 1. If the actuating member 30 is moved upwards in the axial direction, the contact elements 42 with the roller bodies 43 are moved radially outwards so as to make contact with a drill hole wall and thereby form a torque support. In this radial protrusion process into a protruding position the compression springs of the tensioning device 34 are tensioned. Here the axial movement of the actuating member 30 is caused by an axial pressing of the connecting string 12 in the downward direction onto a drilling tool. This pressing takes place automatically in a drilling operation. In this way the invention ensures that during drilling operations the torque support 40 is set to work in a reliable manner. As a result, the contact elements 42 are moved from a retracted position, in which the contact elements 42 rest against stops 48, in the radial outward direction into a protruding position and brought into contact with the drill hole wall.

Upon completion of the drilling operation and an axial lifting of the connecting string 12 with the drilling tool the axial force is released and the ring-shaped actuating member 30 is pressed by the tensioning device 34 back into the lower starting position. In doing so, the contact elements 42 are moved back into the retracted position according to FIG. 1.

In FIG. 3 an extremely schematized arrangement of the connection device 10 according to the invention is shown on a drilling tool 50, which is a cylindrical core barrel in the illustrated embodiment. On the upper first connecting means 14 a Kelly rod or another drill rod 11 can be connected in a known fashion. The latter can be provided in a known manner with further supporting or drilling elements. By preference, in an upper part of the drill rod 11 a hose winding device 36 can be provided, which, upon extension of the drill rod 11, permits a corresponding extension of the fluid lines. The drill rod 11 can be coupled in a known manner with a drill drive in order to drive the drilling tool 50 in a rotating manner.

The invention claimed is:

1. Connection device for forming a fluid supply to a rotatably driven tool (50), comprising:

a rotary feedthrough (20) having a stator (24) and a rotor (22), wherein:

the stator (24) has at least one first line connection (26) for a fluid, said first line connection being stationary with respect to a surrounding environment, the rotor (22) is connectable to the tool (50), is supported in a rotating manner relative to the stator (24), and has at least one second line connection (28), which is stationary with respect to the tool (50), and a torque support (40) which is connected in a rotationally fixed manner to the stator (24) and has at least one contact element (42), wherein:

the at least one contact element (42) is displaceable between a retracted position and a protruding position, the at least one contact element (42) when in the protruding position being extended as compared to the retracted position for the purpose of torque support.

2. Connection device according to claim 1, further comprising a connecting string (12) having a first connecting means (14) for connecting the connecting string (12) to a driving device and a second connecting means (15) for connecting the connecting string to the tool (50), wherein the torque support (40) is arranged along the circumference of the connecting string (12).

3. Connection device according to claim 2, wherein at least one of the first connecting means (14) and the second connecting means (15) is designed as an axially movable rotary connection.

4. Connection device according to claim 2, wherein the connecting string (12) is designed as a hollow shaft for the conveyance of fluid.

5. Connection device according to claim 1, further comprising an axially displaceable actuating member (30) and a transmission means (44) for converting an axial movement of the actuating member (30) into a radial movement of the at least one contact element (42).

6. Connection device according to claim 5, further comprising a connecting string (12) having a first connecting means (14) for connecting the connecting string (12) to a driving device and a second connecting means (15) for connecting the connecting string to the tool (50), wherein the torque support (40) is arranged along the circumference of the connecting string (12), wherein the actuating member (30) is movable through a relative movement of the connecting string (12) with respect to at least one of the tool (50) and the driving device.

7. Connection device according to claim 5, further comprising a connecting string (12) having a first connecting means (14) for connecting the connecting string (12) to a driving device and a second connecting means (15) for connecting the connecting string to the tool (50), wherein the torque support (40) is arranged along the circumference of the connecting string (12), wherein the actuating member (30) is arranged in a ring-shaped manner on the connecting string (12).

8. Connection device according to claim 3, wherein the transmission means (44) includes a lever mechanism.

9. Connection device according to claim 1, further comprising a tensioning device (34) for retaining the at least one contact element (42) in the retracted position.

10. Connection device according to claim 1, further comprising a connecting (12) having a first connecting means (14) for connecting the connecting string (12) to a driving device and a second connecting means (15) for connecting the connecting string to the tool (50), wherein the torque support (40) is arranged along the circumference of the connecting string (12), wherein the torque support has several contact elements (42), and wherein the several contact elements (42) are distributed along the circumference of the connecting string (12).

11. Connection device according to claim 1, wherein the at least one contact element (42) has a roller body (43).

* * * * *